US006655612B2

(12) United States Patent
Oliver

(10) Patent No.: US 6,655,612 B2
(45) Date of Patent: Dec. 2, 2003

(54) NEEDLE/ARMATURE ROTATION LIMITING FEATURE

(75) Inventor: Jack David Oliver, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/770,980

(22) Filed: Jan. 26, 2001

(65) Prior Publication Data

US 2002/0100822 A1 Aug. 1, 2002

(51) Int. Cl.[7] ..... B05B 1/30

(52) U.S. Cl. ..... 239/585.4; 239/533.2; 239/585.1; 251/129.21; 285/360

(58) Field of Search ..... 239/88–92, 533.2–533.12, 239/585.1–585.5; 123/469, 470, 468; 335/263; 251/129.21; 285/302, 303, 305, 360, 361, 375

(56) References Cited

U.S. PATENT DOCUMENTS 4,262,271 A * 4/1981 Bowers et al. ..... 335/263
4,331,317 A * 5/1982 Kaimai et al. ..... 239/585.1
4,382,554 A * 5/1983 Hofmann ..... 239/533.9
4,394,964 A * 7/1983 Ecomard et al. ..... 239/90
4,679,017 A * 7/1987 Mishler et al. ..... 335/263
4,871,989 A * 10/1989 Gross ..... 335/263
5,127,584 A * 7/1992 Sczomak ..... 239/533.11
5,875,972 A * 3/1999 Ren et al. ..... 239/585.4
6,199,539 B1 * 3/2001 Pearlman et al. ..... 123/469

* cited by examiner

*Primary Examiner*—Michael Mar
*Assistant Examiner*—Dinh Q. Nguyen

(57) ABSTRACT

The present invention provides a solenoid actuated fuel injector. The fuel injector includes a housing having a fuel inlet, a fuel outlet, and a fuel passageway extending along a longitudinal axis. The fuel injector additionally includes a valve body having an inlet portion and an armature guide eyelet that is disposed in the inlet portion of the valve body within the fuel passageway. A closure assembly includes an upper bearing guide fixedly connected to a stem portion. The upper bearing guide includes a bearing portion and a contacting portion. The armature guide eyelet includes a first portion circumscribing the upper bearing guide portion, and a second portion engaging the upper bearing guide contacting portion. Methods of mechanically insuring a repeatable stroke of a closure assembly and operating a closure assembly within a solenoid actuated fuel injector are also provided.

16 Claims, 4 Drawing Sheets

NEEDLE/ARMATURE ROTATION LIMITING FEATURE

BACKGROUND OF THE INVENTION

This invention relates to needle/armature assemblies for fuel injectors and more particularly to a needle/armature assembly for a fuel injector with a rotation limiting feature.

The assembly of fuel injectors, in particular, the lift setting, of fuel injectors with an off-center impact point between the armature and inlet tube is believed to be more difficult and time consuming than those fuel injectors designed without an off-center impact point between the armature and inlet tube. The needle/armature assembly of the off-center impact injector appears to demonstrate a tendency to rotate due to the armature and inlet tube surfaces being non-parallel. These off-center impact point injectors have demonstrated to be lift sensitive to the rotational location of the needle/armature assembly relative to the inlet tube. It is believed that this sensitivity is due to the impact surface of the armature and inlet tube being non-parallel. This sensitivity to needle/armature position may result in reduced manufacturer yield of the fuel injector due to failures of the injector with respect to lift and static flow testing. This sensitivity may also contribute to injector lift shift, and resulting flow shift over durability cycling.

It would be beneficial to provide a needle/armature rotational limiting device that overcomes the aforementioned rotational problems in the needle/armatures of offset impact fuel injectors.

BRIEF SUMMARY OF THE INVENTION

Briefly, the present invention provides a solenoid actuated fuel injector with a repeatable stroke. The fuel injector comprises, a housing having a fuel inlet, a fuel outlet, and a fuel passageway extending from the fuel inlet to the fuel outlet along a longitudinal axis. The fuel injector further comprises, a valve body disposed proximate the fuel outlet. The valve body includes an inlet portion and an armature guide eyelet that is disposed in the inlet portion of the valve body within the fuel passageway. The armature guide eyelet is sized to direct and support reciprocal motion of the needle/armature assembly within the fuel passageway along the longitudinal axis.

The solenoid actuated fuel injector also comprises a needle/armature assembly that is reciprocally disposed in and axially aligned with the fuel passageway. The needle/armature assembly includes an upper bearing guide fixedly connected to a needle stem portion. The upper bearing guide comprises a bearing portion and a contacting portion. The armature guide eyelet comprises a first portion that circumscribes the upper bearing guide bearing portion, and a second portion engaging the upper bearing guide contacting portion.

The present invention also provides a method of mechanically insuring a repeatable stroke of a needle/armature assembly within a solenoid actuated fuel injector. The method comprises, providing a housing that includes a fuel inlet, a fuel outlet, and a fuel passageway that extends from the fuel inlet to the fuel outlet along a longitudinal axis. The method further comprises, providing a valve body disposed proximate the fuel outlet. The method additionally comprises, providing a needle/armature assembly reciprocally disposed in and axially aligned with the fuel passageway.

The needle/armature assembly includes an upper bearing guide fixedly connected to a needle stem portion. The method includes, providing an armature guide eyelet disposed in an inlet portion of the valve body within the fuel passageway. The armature guide eyelet is sized to direct and support the reciprocal motion of the needle/armature assembly within the fuel passageway along the longitudinal axis. The method further includes, forming a bearing portion and a contacting portion on the upper bearing guide of the needle/armature assembly. The method also includes, forming a first portion of the armature guide eyelet that circumscribes the upper bearing guide bearing portion and forming a second portion of the armature guide eyelet that abuts the upper bearing guide contacting portion. The method additionally includes, engaging the second portion of the armature guide eyelet and the contacting portion of the upper bearing guide of the needle/armature assembly.

The present invention further provides a method of operating a needle/armature assembly within a solenoid actuated fuel injector. The method comprises actuating reciprocal motion of the needle/armature assembly within a valve body of the solenoid actuated fuel injector. The method further comprises limiting the axial rotation of the needle/armature assembly within the valve body of the solenoid actuated fuel injector.

BRIEF DESCRIPTION OF THE DRAWINGS

The accompanying drawings, which are incorporated herein, and constitute part of this specification, illustrate the presently preferred embodiments of the invention, and, together with the general description given above and the detailed description given below, serve to explain the features of the invention. In the drawings.

DETAILED DESCRIPTION OF THE PREFERRED EMBODIMENTS

Fuel injectors are used to provide a metered amount of fuel in an internal combustion engine. Details of the operation of the fuel injector 100 in relation to the operation of the internal combustion engine (not shown) are well known and will not be described in detail herein, except as the operation relates to the preferred embodiments. Although the preferred embodiments are generally directed to injector valves for internal combustion engines, those skilled in the art will recognize from present disclosure that the preferred embodiments can be adapted for other applications in which precise metering of fluids is desired or required.

An offset impact fuel injector 100 into which the present invention can be incorporated is disclosed in U.S. patent application Ser. No. 09/470,983 filed Dec. 23,1999, owned by the assignee of the present invention, which is incorporated herein by reference in its entirety.

Figure 1:
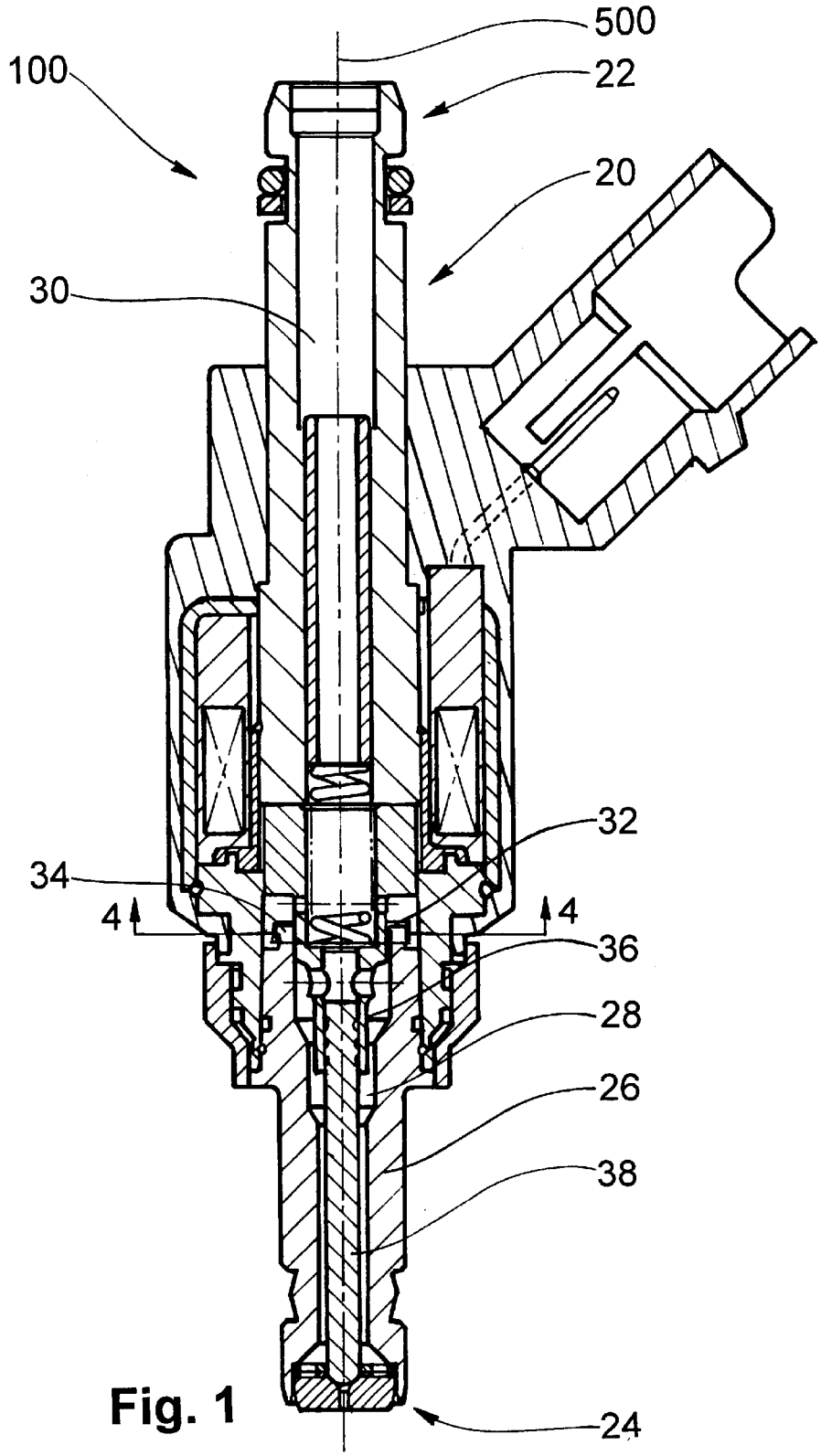
FIG. 1 is a side view, in section, of an offset impact fuel injector of the present invention.

FIG. 1 shows an offset impact fuel injector 100, according to the present invention. As used herein, like numerals indicate like elements throughout. The injector 100 includes a housing 20 having a fuel inlet 22, a fuel outlet 24, and a fuel passageway 30 extending from the fuel inlet 22 to the fuel outlet 24 along a longitudinal axis 500.

The injector 100 includes a valve body 26 that is disposed proximate the fuel outlet 24 along the longitudinal axis 500. The injector 100 additionally includes a needle/armature assembly 28 reciprocally disposed in the valve body 26 and axially aligned in the fuel passageway 30.

An armature guide eyelet 32 is disposed and fixedly connected in an inlet portion 34 of the valve body 26. The armature guide eyelet 32 is fabricated out of a non-magnetic steel material. Those skilled in the art should recognize that the armature guide eyelet 32 can be fabricated out of any other suitable non-magnetic material. The armature guide eyelet 32 is sized to direct and support the reciprocal motion of the needle/armature assembly 28 within the fuel passageway 30 along the longitudinal axis 500. The needle/armature assembly 28 is comprised of an upper bearing guide 36 fixedly connected to a needle stem portion 38. The needle/armature assembly 28 forms a closure assembly defining an outer perimeter about the longitudinal axis 500 that has a portion with a constant diameter contiguous to another portion with varying radii (as shown in FIGS. 2, and 4–7), which assembly 28 is free floating in the armature guide eyelet 32, but is limited in rotation within the fuel passageway 30 along the longitudinal axis 500.

Figure 2:
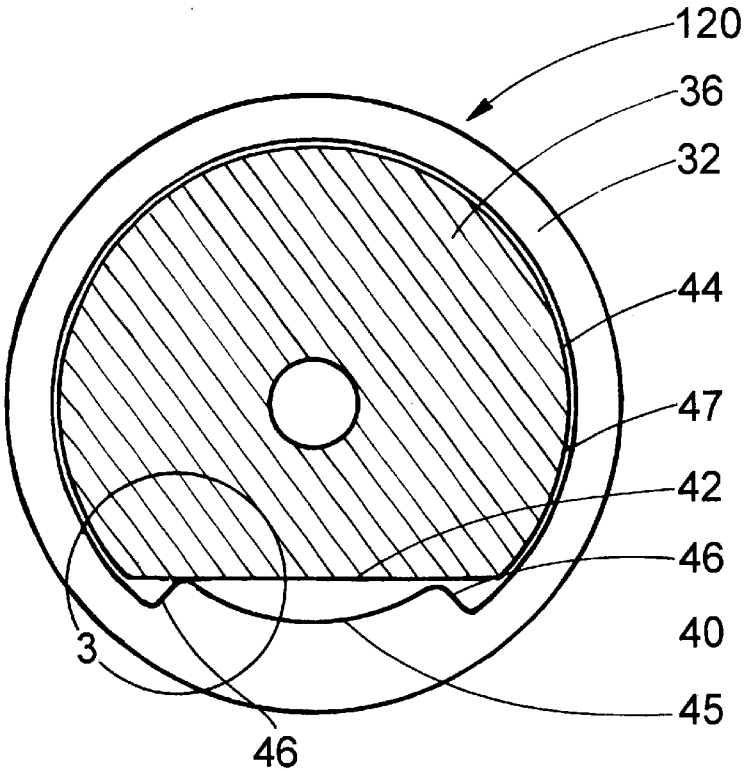
FIG. 2 is a sectional view of the fuel injector taken along line 4–4 of FIG. 1, showing an assembly of the armature upper bearing guide and armature guide eyelet according to the first preferred embodiment of the present invention.

FIG. 2 shows a cross sectional view of an upper bearing guide/armature eyelet guide assembly 120 according to a first preferred embodiment of the present invention. The bearing/guide assembly 120 is comprised of the armature guide eyelet 32 and the upper bearing guide 36.

The upper bearing guide 36 comprises a contacting portion 42 that extends inward from a bearing portion 44 of the upper bearing guide 36. The words "inward" and "outward" designate directions in the drawing to which reference is made. "Inward" is defined to mean in a direction toward the longitudinal axis 500 of the figure referred, and "outward" is defined to mean in a direction away from the longitudinal axis 500 of the figure referred.

The armature guide eyelet 32 comprises a first portion 40 that circumscribes the upper bearing guide 36 bearing portion 44, and a second portion 45 that engages the upper bearing guide 36 contacting portion 42. The first portion 40 is connected to the second portion 45 of the armature guide eyelet 32 by lateral projections 46 extending inward.

Figure 3:
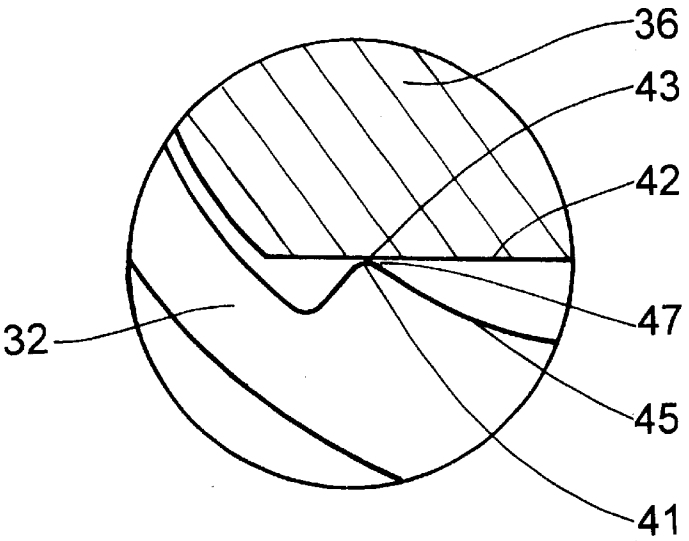
FIG. 3 is an enlarged view of the engagement of the abutting contact portions of the armature upper bearing guide and armature guide eyelet assembly according to the first preferred embodiment of the present invention.

FIG. 3 shows an enlarged view of the engagement between the contacting portion 42 and the second portion 45. The amount of clearance 47 between the armature guide eyelet 32 and the upper bearing guide 36 ranges from approximately 30 to 50 microns, with 40 microns being preferred. An abutting portion 43 on the contacting portion 42 of the upper bearing guide 36 interlocks an abutting portion 41 on the second portion 45 of the armature guide eyelet 32. With the exception of the clearance 47, the abutting engagement as shown in FIG. 3 limits the free rotational movement of the upper bearing guide 36 with respect to the fixed armature guide eyelet 32.

It should be recognized by those skilled in the art that the direction of the contacting portion 42 on the upper bearing guide 36 and the second portion 45 on the armature guide eyelet 32 could be directed outward away from the longitudinal axis 500 of the fuel injector 100.

Figure 4:
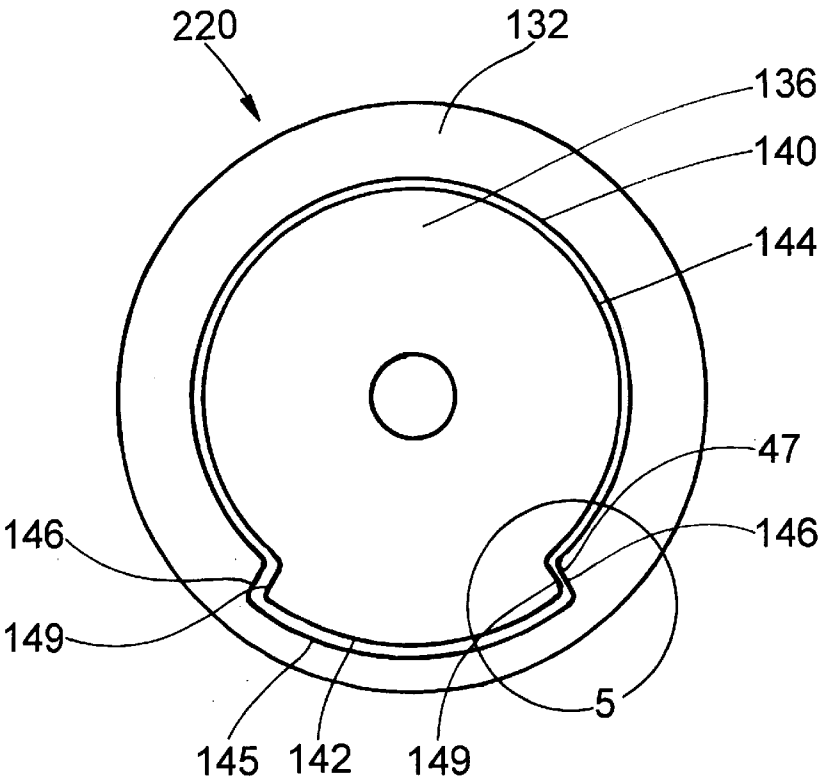
FIG. 4 is a top plan view of a second preferred embodiment of the present invention showing an assembly of the armature upper bearing guide and armature guide eyelet assembly.

For example, FIG. 4 shows a top plan view of a second preferred embodiment of a bearing/guide assembly 220 having outward protrusions. The bearing/guide assembly 220 is comprised of an armature guide eyelet 132 and an upper bearing guide 136. The upper bearing guide 136 comprises a contacting portion 142 that extends outward from a bearing portion 144 of the upper bearing guide 136. The contacting portion 142 is connected to the bearing portion 144 of the upper bearing guide 136 via lateral projections 149 that extend outward.

Additionally, FIG. 4 shows the detail of the armature guide eyelet 132. The armature guide eyelet 132 comprises a first portion 140 that circumscribes the upper bearing guide 136 bearing portion 144, and a second portion 145 that engages the upper bearing guide 136 contacting portion 142. The first portion 140 is connected to the second portion 145 of the armature guide eyelet 132 via lateral projections 146 that extend outward.

Figure 5:
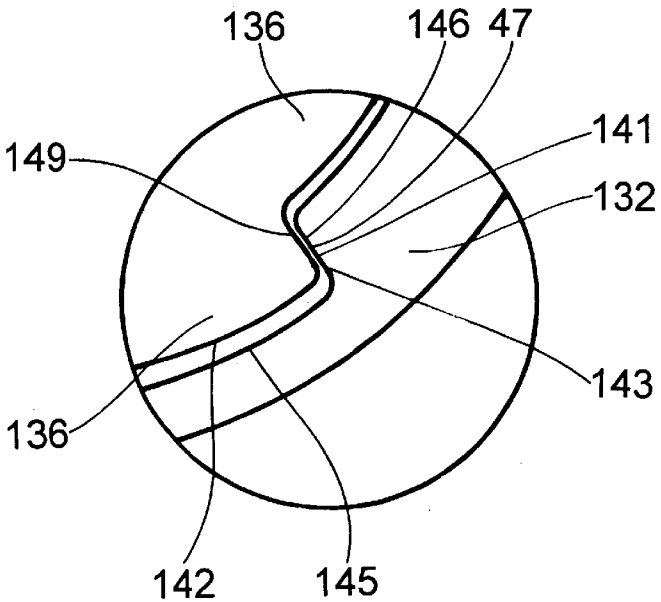
FIG. 5 is an enlarged view of the interlocking engagement between the armature upper bearing guide and armature guide eyelet assembly according to the second preferred embodiment of the present invention.

FIG. 5 shows an enlarged view of the interlocking engagement between the contacting portion 142 and the second portion 140. A abutting portion 143 on the lateral projection 149 of the upper bearing guide 136 interlocks an abutting portion 141 on the lateral projection 146 of the armature guide eyelet 132. With the exception of the clearance 47, the interlocking engagement as shown in FIG. 9 limits the free rotational movement of the upper bearing guide 136 with respect to the fixed armature guide eyelet 132.

In addition to the direction of the protrusion, it should be recognized by those skilled in the art that the shape of the mating protrusions could be flat, square, triangular or any other shape as desired without departing from the sprit and scope of the claimed invention.

Figure 6:
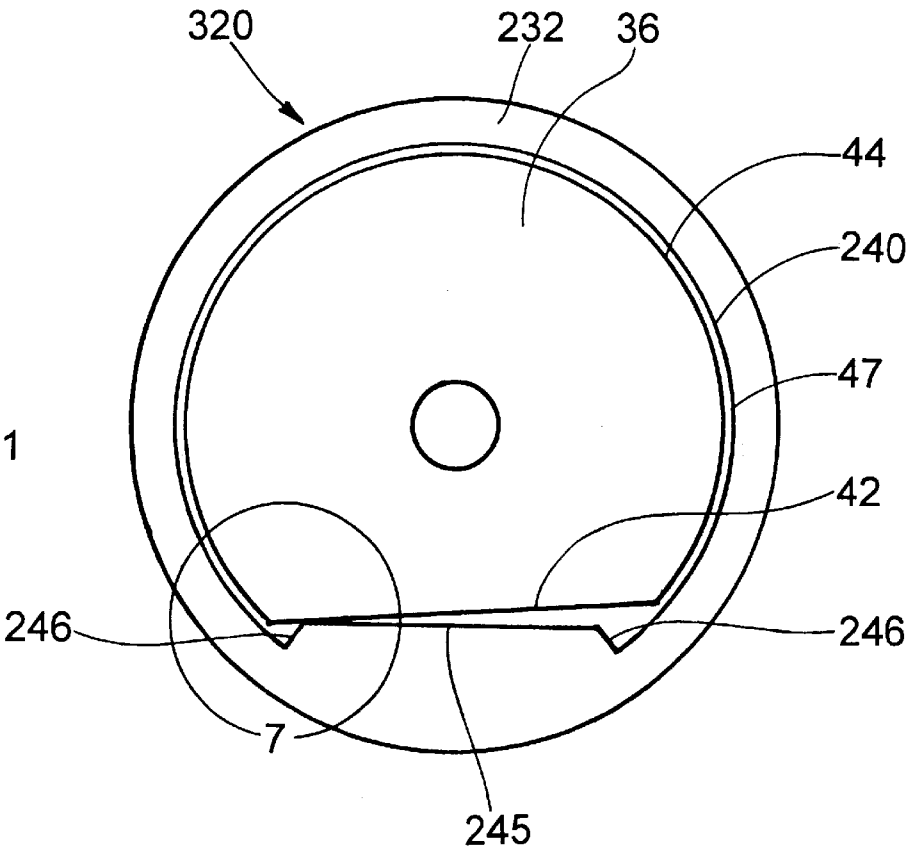
FIG. 6 is a top plan view of an alternate version of the first embodiment of the present invention showing an assembly of the armature upper bearing guide and armature guide eyelet.

For example, FIG. 6 shows a bearing/guide assembly 320 that depicts an alternate version of the bearing/guide assembly 120 of the first embodiment as shown in FIG. 2. The upper bearing guide 36 has been disclosed from the first preferred embodiment as shown in FIG. 3.

Additionally, FIG. 6 shows an armature guide eyelet 232 that comprises a first portion 240 that circumscribes the upper bearing guide 36 bearing portion 44, and a second portion 245 that engages the upper bearing guide 36 contacting portion 42. The second portion 245 is flat. The first portion 240 is connected to the second portion 245 of the armature guide eyelet 232 via lateral projections 246 that extend inward.

Figure 7:
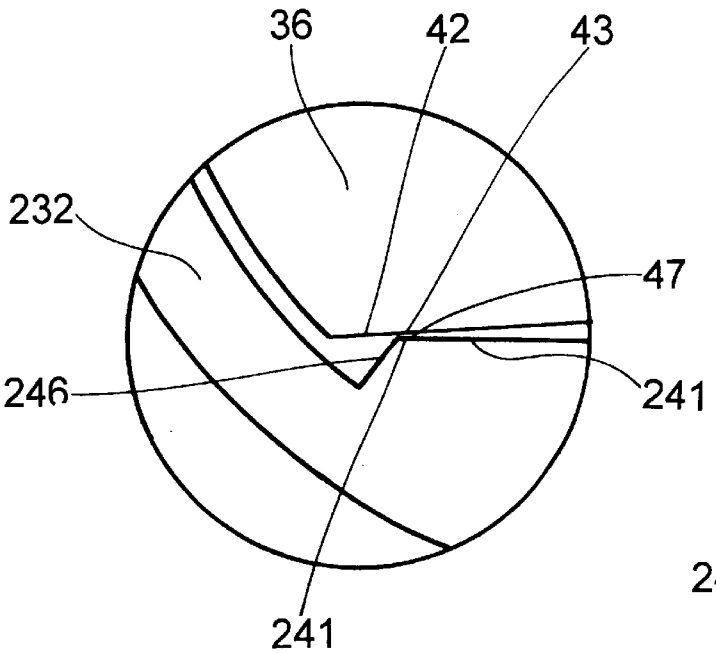
FIG. 7 is an enlarged view of the alternate version of the first preferred embodiment of the present invention showing the engagement of the abutting contact portions of the armature upper bearing guide and armature guide eyelet assembly.

FIG. 7 shows an enlarged view of the engagement between the contacting portion 42 and the second portion 245. The contacting portion 43 on the flat protrusion 42 of the upper bearing guide 36 abuts a contacting portion 241 on the lateral projection 246 of the armature guide eyelet. With the exception of the clearance 47, the abutting engagement as shown in FIG. 7 limits the free rotational movement of the upper bearing guide 36 with respect to the fixed armature guide eyelet 232.

A method of mechanically limiting rotation of the needle/armature assembly 28 within the offset impact fuel injector 100 of the present invention will now be disclosed. According to the first preferred embodiment, the method comprises, engaging the upper bearing guide 36 within the armature guide eyelet 32, thus guiding the reciprocal motion of the needle/armature assembly 28 within the passageway 30 of the fuel injector 100 along the longitudinal axis 500.

In addition to guiding the reciprocal motion, the method comprises limiting rotation of the upper bearing guide 36 of the needle/armature assembly 28 by engaging the abutting portion 43 of the flat contacting portion 42 of the upper bearing guide 36 and the abutting portion 41 of the first portion 40 of the armature guide eyelet 32.

A method of operating the needle/armature assembly 28 within the solenoid actuated fuel injector 100 will now be disclosed. The method comprises actuating reciprocal motion of the needle/armature assembly 28 within the valve body 26 of the solenoid actuated fuel injector 100. As the needle/armature assembly 28 reciprocates within the valve body 26 the axial rotation of the needle/armature assembly 28 is limited. The axial rotation of the needle/armature assembly 28 is limited through engagement between the armature guide eyelet 32 and the upper bearing guide 36. Further, a repeatable stroke (not shown) of the needle/armature 28 assembly is insured through engagement between the upper bearing guide 36 contacting portion 42 and the second portion 45 of the armature guide eyelet 32.

It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined in the appended claims.

What is claimed is:

1. A fuel injector comprising:

a housing having a fuel inlet, a fuel outlet, and a fuel passageway extending from the fuel inlet to the fuel outlet along a longitudinal axis;

a valve body disposed proximate the fuel outlet, the valve body having an inlet portion, and an armature guide eyelet disposed in the inlet portion of the valve body within the fuel passageway, the armature guide eyelet sized to direct and support reciprocal motion of a closure assembly within the fuel passageway along the longitudinal axis;

a closure assembly reciprocally disposed in and axially aligned with the fuel passageway, the closure assembly including an upper bearing guide fixedly connected to a stem portion;

the upper bearing guide including a bearing portion and a contacting portion; and the armature guide eyelet including a first portion circumscribing the upper bearing guide bearing portion, and a second portion engaging the upper bearing guide contacting portion.

2. The fuel injector according to claim 1 wherein engagement between the upper bearing guide contacting portion and armature guide eyelet second portion insure a repeatable stroke of the closure assembly.

3. A fuel injector comprising:

a housing having a fuel inlet, a fuel outlet, and a fuel passageway extending from the fuel inlet to the fuel outlet along a longitudinal axis;

a valve body disposed proximate the fuel outlet, the valve body having an inlet portion, and an armature guide eyelet disposed in the inlet portion of the valve body within the fuel passageway, the armature guide eyelet sized to direct and support reciprocal motion of a closure assembly within the fuel passageway along the longitudinal axis;

a closure assembly reciprocally disposed in and axially aligned with the fuel passageway, the closure assembly including an upper bearing guide fixedly connected to a stem portion;

the upper bearing guide including a bearing portion and a contacting portion; and the armature guide eyelet including a first portion circumscribing the upper bearing guide bearing portion, and a second portion engaging the upper bearing guide contacting portion, wherein both the contacting portion of the upper bearing guide and the second portion of the armature guide eyelet comprise a flat surface.

4. A fuel injector comprising:

a housing having a fuel inlet, a fuel outlet, and a fuel passageway extending from the fuel inlet to the fuel outlet along a longitudinal axis;

a valve body disposed proximate the fuel outlet, the valve body having an inlet portion, and an armature guide eyelet disposed in the inlet portion of the valve body within the fuel passageway, the armature guide eyelet sized to direct and support reciprocal motion of the closure assembly within the fuel passageway along the longitudinal axis;

a closure assembly reciprocally disposed in and axially aligned with the fuel passageway, the closure assembly including an upper bearing guide fixedly connected to a stem portion;

the upper bearing guide including a bearing portion and a contacting portion; and the armature guide eyelet including a first portion circumscribing the upper bearing guide bearing portion, and a second portion engaging the upper bearing guide contacting portion, wherein the second portion projects toward the longitudinal axis.

5. The fuel injector according to claim 4 wherein at least one lateral projection connects the first portion and second portion of the armature guide eyelet.

6. A fuel injector comprising:

a housing having a fuel inlet, a fuel outlet, and a fuel passageway extending from the fuel inlet to the fuel outlet along a longitudinal axis;

a valve body disposed proximate the fuel outlet, the valve body having an inlet portion, and an armature guide eyelet disposed in the inlet portion of the valve body within the fuel passageway, the armature guide eyelet sized to direct and support reciprocal motion of the closure assembly within the fuel passageway along the longitudinal axis;

a closure assembly reciprocally disposed in and axially aligned with the fuel passageway, the closure assembly including an upper bearing guide fixedly connected to a stem portion;

the upper bearing guide including a bearing portion and a contacting portion; and the armature guide eyelet including a first portion circumscribing the upper bearing guide bearing portion, and a second portion engaging the upper bearing guide contacting portion, wherein both the contacting portion of the upper bearing guide and the second portion of the armature guide eyelet project away from the longitudinal axis.

7. The fuel injector according to claim 6 wherein at least one eyelet lateral projection connects the first portion and the second portion of the armature guide eyelet.

8. The fuel injector according to claim 7 wherein at least one bearing lateral projection connects the contacting portion of the upper bearing guide and the bearing portion of the upper bearing guide.

9. The fuel injector according to claim 8 wherein a contacting portion disposed on one of the at least one bearing lateral projections engages a contacting portion disposed on one of the at least one lateral eyelet projections.

10. The fuel injector of any one of claims 1, 3, 4, and 6, wherein the closure assembly comprises an armature coupled to a needle.

11. A method of mechanically insuring a repeatable stroke of a closure assembly within a solenoid actuated fuel injector, the method comprising:

providing a housing including a fuel inlet, a fuel outlet, and a fuel passageway extending from the fuel inlet to the fuel outlet along a longitudinal axis;

providing a valve body disposed proximate the fuel outlet; providing a closure assembly reciprocally disposed in and axially aligned with the fuel passageway, the closure assembly including an upper bearing guide fixedly connected to a stem portion;

providing an armature guide eyelet disposed in an inlet portion of the valve body within the fuel passageway, the armature guide eyelet sized to direct and support reciprocal motion of the closure assembly within the fuel passageway along the longitudinal axis;

forming a bearing portion and a contacting portion on the upper bearing guide of the closure assembly;

forming a first portion of the armature guide eyelet circumscribing the upper bearing guide bearing portion;

forming a second portion of the armature guide eyelet abutting the upper bearing guide contacting portion; and engaging the second portion of the armature guide eyelet and the contacting portion of the upper bearing guide of the closure assembly.

12. The method of any one of claims 11, 13, and 15, wherein the closure assembly comprises an armature coupled to a needle.

13. A method of mechanically insuring a repeatable stroke of a closure assembly within a solenoid actuated fuel injector, the method comprising:

providing a housing including a fuel inlet, a fuel outlet, and a fuel passageway extending from the fuel inlet to the fuel outlet along a longitudinal axis;

providing a valve body disposed proximate the fuel outlet; providing a closure assembly reciprocally disposed in and axially aligned with the fuel passageway, the closure assembly including an upper bearing guide fixedly connected to a stem portion;

providing an armature guide eyelet disposed in an inlet portion of the valve body within the fuel passageway, the armature guide eyelet sized to direct and support reciprocal motion of the closure assembly within the fuel passageway along the longitudinal axis; forming a bearing portion and a contacting portion on the upper bearing guide of the closure assembly;

forming a first portion of the armature guide eyelet circumscribing the upper bearing guide bearing portion;

forming a second portion of the armature guide eyelet abutting the upper bearing guide contacting portion; and engaging the second portion of the armature guide eyelet and the contacting portion of the upper bearing guide of the closure assembly, wherein the engagement of the second portion of the armature guide eyelet and the contacting portion of the upper bearing guide of the closure assembly within the fuel passageway limits rotation of the second portion with respect to the contacting portion.

14. The method according to claim 13, further comprising mechanically insuring the repeatable stroke of the closure assembly by limiting rotation of the closure assembly within the fuel passageway.

15. A method of operating a closure assembly within a solenoid actuated fuel injector, the fuel injector having a member surrounding the closure assembly, the closure assembly defining an outer perimeter about a longitudinal axis having a portion of a constant diameter contiguous to a portion with varying radii, the method comprising:

actuating reciprocal motion of the closure assembly within a valve body of the solenoid actuated fuel injector; and limiting axial rotation of the portion of constant diameter of the closure assembly within the valve body of the solenoid actuated fuel injector.

16. The method according to claim 15, further comprising directing and supporting reciprocal motion of the closure assembly by an armature guide eyelet disposed in an inlet portion of the valve body within a fuel passageway.

* * * * *